United States Patent [19]

Anderson, Sr.

[11] Patent Number: 4,857,803

[45] Date of Patent: Aug. 15, 1989

[54] METHOD OF PRODUCING ELECTROLUMINESCENCE AND ELECTROLUMINESCING LAMP

[75] Inventor: Scott Anderson, Sr., Champaign, Ill.

[73] Assignee: Advanced Lighting International, Oak Wood Village, Ohio

[21] Appl. No.: 865,392

[22] Filed: May 21, 1986

[51] Int. Cl.[4] ..... H05B 33/14; H05B 33/22; H05B 33/28

[52] U.S. Cl. ..... 313/509; 313/506

[58] Field of Search ..... 313/498, 503, 506, 509; 357/17

[56] References Cited

U.S. PATENT DOCUMENTS

| | | | |
|---|---|---|---|
| 4,081,764 | 3/1978 | Christmann et al. | 313/499 X |
| 4,373,145 | 2/1983 | McCarthy et al. | 313/506 X |
| 4,603,280 | 7/1986 | Pankove | 313/509 |
| 4,620,132 | 10/1986 | Gordon et al. | 313/463 X |

*Primary Examiner*—Kenneth Wieder

*Attorney, Agent, or Firm*—L. Lawton Rogers, III; Joseph M. Killeen

[57] ABSTRACT

A method of producing electroluminescence without a chemical reaction by providing a metal oxide containing electron traps, (i.e., holes or distortion of the lattice of the oxide by impurities or surface states), providing free electrons at an energy level in the conduction band and trapping the electrons to release photons. Alternatively, electroluminescence may be produced without a chemical reaction by the decay of the energy level of electrons from an excited state which results from collision of accelerated free electrons with ions in the oxide, the free electrons being provided externally of the oxide (e.g., by an electron gun or the application of a high field to an insulator contiguous to the oxide) or by space charges within the oxide or adjacent to the boundary thereof. Electroluminescing lamps are also disclosed.

26 Claims, 1 Drawing Sheet

METHOD OF PRODUCING ELECTROLUMINESCENCE AND ELECTROLUMINESCING LAMP

BACKGROUND OF THE INVENTION

The present invention is directed to a method and apparatus for producing electroluminescence without a chemical reaction.

It has long been known that certain metals such as aluminum (Al), magnesium (Mg), tantalum (Ta), titanium (Ti), thallium (Tl), tungsten (W), zirconium (Zr), and zinc (Zn) will emit light when anodized in certain aqueous electrolytes, such as citric acid, oxalic acid, ammonium oxalate, phosphoric acid, dilute sulfuric acid, etc. In all known instances, the significant characteristic of the electrolyte has been that it permits the formation of an oxide coating upon the metal used as the anode in the anodizing process.

The oxides of these metals are "excess" or "N-type" semi-conductors. For a given alloy, the luminous intensity per watt may vary as a function of the electrolyte. For a given electrolyte, the luminous intensity per watt may vary with the impurity and its concentration in the alloy. The color of the luminescence is known to be a function of the alloy of the particular metal and independent of the electrolyte, i.e., a function of the energy given up by an excited electron as it assumes a stable state.

It is also generally known that luminescence is a property of the oxide and involves energy levels of 2.2–3.0 electron volts, as a function of the nature of the impurities in the metal. The rectifying properties of the electrolyte/semi-conductor/metal combinations result from the accumulation of space charges within the oxide and vary as a function of the type of semi-conductor and the direction of current flow. This accumulation of space charges gives rise to high electric fields within the oxides. It has been shown by Anderson (J. Appl. Physics Vol. 14, No. 601 (1943)), that the space charges within the oxide may be shifted with alternating potentials, in which event the cathodic flash augments the intensity of the anodization luminescence at certain frequencies of the alternating current.

Notwithstanding the knowledge that electroluminescence can be produced uniformly over the area of the metal during the growth of certain oxides in the presence of an aqueous solution as described above, efforts to produce an analogous electroluminescence in the absence of a chemical reaction and/or a solid state electroluminescing lamp have not succeeded. Hickmott (J. Appl. Phys., Vol. 36, No. 6, June 1965) showed electroluminescence of metal oxides in the absence of a chemical reaction, but such luminescence is non-uniform over the area of the metal oxide and exists only after breakdown of the dielectric.

The production of electroluminescence by a chemical reaction is unacceptable for applications such as lamps. In addition to the problems inherent in the handling of acids, any such reaction inevitably exhausts the reactants, may create problems in the handling of the undesired by-products of the reaction, etc.

Attempts to produce electroluminescence in the dry state are reported by Wesolowski, et al., (Acta Physica Polonica, Vol. XX, No. 4 (1961)) where pure aluminum was anodized in oxalic acid by a constant current (2–5 ma/cm$^2$) and by a constant voltage (24–240 volts d.c.), where the oxide surface thereof was coated with a transparent N-type semi-conductor (cadmium oxide CdO by cathodic reactive sputtering; and tin oxide $SnO_2$ by chemical deposition), and where luminescence was observed upon the application of a strong electric field between the positive and negative semi-conductor electrodes. However, as cautioned therein, and as explained in Wesolowski (Acta Physica Polonica, Vol. XXIV, No. 3(9) (1963)), the electroluminescence of such metal/oxide/semi-conductor structures is dependent on the presence of liquid water (and thus a chemical reaction) as in the well known process by which aluminum is anodized in a liquid electrolyte.

It is accordingly an object of the present invention to provide a novel method of producing electroluminescence without any chemical reaction.

It is another object of the present invention to provide a novel method of producing electroluminescence without the decomposition of water.

It is a further object of the present invention to provide a novel method of producing electroluminescence in the absence of a carboxylic acid.

It is still another object of the present invention to provide a novel method of producing electroluminescence by electron bombardment.

It is yet still another object of the present invention to provide a novel method of electroluminescence by the decay of the energy levels of electrons of metal ions from an excited state which results from a collision with an accelerated free electron.

It is yet a further object of the present invention to provide a novel method of electroluminescence in metal oxides by electrons from an insulator subjected to a high field.

It is yet still a further object of the present invention to provide a novel method of electroluminescence in metal oxides by the acceleration of electrons from space charges.

It is yet another object of the present invention to provide a novel solid state electroluminescing lamp.

It is still a further object of the present invention to provide a novel electroluminescing lamp using a doped metal oxide.

Yet still a further object of the present invention is to provide a novel electroluminescing lamp using an electrolytically produced metal oxide adherent to a metal substrate.

An additional object of the present invention is to provide a novel electroluminescing lamp operable at low current and power levels, with increased efficiency.

These and many other objects and advantages of the present invention will be apparent from the claims and from the following description when read in conjunction with the appended drawings.

THE DETAILED DESCRIPTION OF PREFERRED EMBODIMENTS

Figure 1:
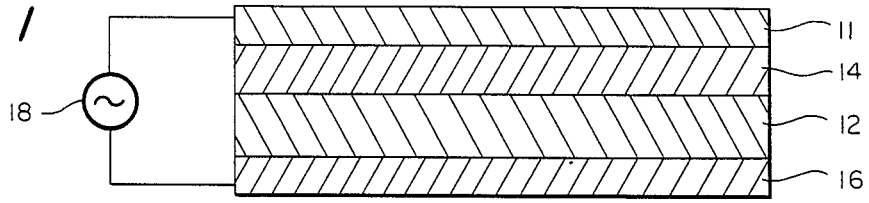
FIG. 1 is a section in elevation of one embodiment of the lamp of the present invention.

The methods of the present invention produce electroluminescence without a chemical reaction. In one embodiment, a metal oxide containing electron traps within the oxide is provided and high energy (i.e., conduction band) free electrons are trapped in the electron traps of the metal oxide to release energy in the form of light.

The metal oxide is of the "excess" or "N-type" semiconductor, electrolytically grown and adherent to the metal in its production.

The electron "traps" may include electron holes where an electron has been removed from the valence band (e.g., copper oxide with an excess of oxygen) as well as traps produced by distortion of the lattice of the oxide (e.g., by the inclusion of impurities in the metal oxide or the surface state of the metal oxide).

The trapped electron must have attained an energy level in the conduction band in order to release energy in the form of a photon when trapped. It may acquire that energy in any manner. For example, free electrons within the oxide may acquire the necessary energy level through excitation by means of an electric field, or may be accelerated by the space charges within the oxide. Alternatively, the free electrons may acquire the necessary energy level externally of the oxide, e.g., through acceleration by an electric field or by space charges in materials adjacent to the oxide boundary.

Electroluminescence may also be produced without the trapping of free electrons. For example, the electrons in the valence bands of the metal ions of the oxide, upon collision with a bombarding free electron, may acquire an excited state without being removed from the vicinity of the "parent" ion, i.e., it may be excited from the valence band to a level in the band gap. Such electrons will not long remain in this excited state and give up the excess energy as photons in resuming their normal state in the valence band. The color of such luminescence will be characteristic of the excited ion, normally an impurity.

The electrons which bombard the oxide may by such collision excite a bombarded electron to a conduction band energy level and be displaced from the "parent" ion, thereby creating a hole which in turn may trap a second conduction band energy electron and cause the emission of that energy as a photon. These two mechanisms may occur simultaneously in any electron bombardment.

Electrons for bombardment may be accelerated externally of the oxide by an electric field, e.g., by a suitable conventional source such as an electron gun, or by the application of high-field to an insulator while maintaining continuous electrical contact with the insulator by way of an optically transparent, electrically conducting coating, e.g., one evaporated thereon. The electrons may also be accelerated internally in the oxide as a result of the high field gradients or space charges.

Providing a Metal Oxide

The metal oxide is adherent to the metal in the production process, i.e., electrolytically grown oxides have proven satisfactory while oxide produced by a chemical reaction have not. In all cases the resultant oxide must be an "excess" or "N-type" semi-conductor.

The metal may be pure or may be doped the impurities as in the case of alloys. For example, the light emitted from pure aluminum is blue-white in color and that emitted from an aluminum/manganese alloy is primarily yellow in color. Thus the color of the light is a function of both the alloy and its concentrations, and may produce a spread of colors. Selected rare earth metals may be added for this purpose.

The resulting oxide must be porous rather than a single crystal. Surprisingly, porous unsealed oxides grown in 0.5% oxalic acid produced oxide films having higher resistance and greater and more uniform luminescence in the dry state than the films produced by non-porous oxides such as $Al_2O_3$ grown in boric acid. An exception to this rule appears to be alumina trihydrate which forms when the porous oxalic acid grown oxide layers are soaked in boiling water.

The depth of the oxide layer is not believed to be critically important. However, the oxide layer thickness must exceed about 100 Å in thickness to prevent the electrons from crossing the layer by quantum mechanical tunnelling, a radiationless transition. It is expected that the layer will have to approach 500 Å in thickness to develop the necessary space charge and to provide sufficient numbers of manganese ions for appreciable light. The surface of the oxide layer is oxygen enriched while the layer adjacent the metal is enriched with the metal ions. The oxygen enriched layer remains fairly constant in depth as the oxide is formed into the metal, and it is thought that it is the outer layer which provides most of the luminescence.

By way of example only, oxides have been produced as follows:

Example No. 1: A metal oxide was produced by anodizing No. 3003 aluminum alloy in a 0.5% oxalic acid solution for 60 minutes at a current of 6 ma/cm$^2$ at 30 volts and a temperature of approximately 50° C. The resulting oxide was about 6,000 Å in thickness. Since the oxide was intended to serve as the dielectric of a condenser, a substantially impervious film was desired to contain a high electric field within the oxide. Accordingly, the oxide was thereafter sealed by soaking in boiling water for one hour. As a result of this exposure to the hot water, the surface of the oxide was sealed by the formation of aluminum trihydrate.

Example No. 2: An oxide was provided from No. 3003 aluminum alloy, by anodization for 120 minutes in a 3.2% boric acid with a direct current which varied from 60 ma/cm$^2$ to 1 ma/cm$^2$, at a voltage which varied from 20 to 400 volts and a temperature between 21° C. and 60° C. The resulting oxide was estimated to be approximately 4000 Å thick as it is well established that pure Al develops an oxide layer thickness equal to approximately 12.7 A/volt (about 12.5–13.2 A/volt). The resulting oxide had a resistance of about 3 ohms in the dry state.

Example No. 3: A panel of No. 3003 aluminum alloy was anodized for 4 hours at six ma/cm$^2$ in 0.5% oxalic acid with a voltage varying between 40 and 100 volts. The resultant oxide was approximately 5,000 Å thick with resistance greater than 20 megohms after drying.

Example No. 4: An oxide was produced by anodization of No. 3003 aluminum alloy for 60 minutes in 0.5% oxalic acid at 6 ma/cm$^2$ and a voltage between 20 and 40 volts. The resulting oxide film had a thickness of approximately 5,000 Å and a resistance of 1.7 megohms.

Example No. 5: A panel of No. 3004 aluminum alloy was anodized in a 0.5 % oxalic acid for 4 hours at 6 ma/cm$^2$ and 50–120 volts. The resulting oxide had a thickness of approximately 6,000 Å and a resistance greater than twenty megohms.

Providing Free Electrons

Free electrons in the metal oxide may be provided in any suitable conventional manner. Upon the application of a potential difference which exceeds the work function of a surface, electronic and/or some ionic current will flow.

The electrons may exist in the metal oxide, may be introduced into the metal oxide at an energy level in the conduction band, or introduced at a low energy level and then accelerated and/or excited to conduction band energy level within the oxide. Conduction band energy level free electrons may be space charge accelerated or provided from an external source such as an electron gun, in which the electrons are accelerated in an electric field external of the oxide.

Electrons may also be produced within a solid electronic conductor such as barium titanate. Methods of introducing low energy level electrons for subsequent excitation include the existence of space charges which may accelerate the electrons to move through an oxide lattice and discharge electrons upon collision in the manner of light emitting diodes.

Traps may also be provided by a hole injector such as a thin film of copper phthalocyanine (Cu Pc).

Trapping of Electrons to Release Energy As Photons

As is well known, the energy above that required to maintain and electron in its position in the lattice of the oxide is emitted in the form of light when an electron is trapped. Such traps may include holes resulting from impurities in the oxide, surface effects and any other distortion of the lattice.

Collision Exciting Of Ions To Release Energy As Photons

Electrons associated with the metal ions in the oxide lattice may be temporarily excited and emit photons when resuming a normal energy level. For example, the electrons associated with the metal ions in the oxide lattice may be excited upon collision with the accelerated electrons to an energy level insufficient to enter the conduction band but sufficient to emit a photon upon relaxation to its stable state.

SOLID STATE LAMPS

The solid state electroluminescing lamp of the present invention may take the form illustrated in FIG. 1. With reference to FIG. 1, a flat plate of metal (10) may serve as one electrode of the lamp with an oxide layer (12) containing the electron traps grown therein on one flat surface. A suitable electron source or insulator (14) is placed thereover. Thereafter a semi-transparent electrode (16) layer may be provided as the second electrode, and both electrodes connected to a suitable alternating current source of electrical power (18). The insulator is necessary to limit the current and to provide a region of high field gradient upon the application of a potential.

Example No. 6: To produce electroluminescence by bombardment with high-speed electrons, an oxidized panel was prepared according to Example No. 2 above. An electron gun for a darktrace tube with a four inch tube having a side-arm for evacuation purposes was cemented into the panel and a plate-to-cathode potential of about 10,000 volts established. Even in the absence of significant focusing, a rather bright, yellow light was emitted when the electrons struck the panel.

Example No. 7: As discussed above, electrons may acquire the necessary energy to excite electroluminescence with the oxide during anodization because of the space charges and the resultant high field gradient.

A dry electrolytic lamp was made by preparing a panel as set out in Example No. 5 above. The panel was then immersed in a 25% manganese nitrate solution for 30 seconds. The panel was removed from the solution and, while dripping wet, placed on a hot plate at 248°–260° C. for four minutes. Thereafter the excess rough surface manganese dioxide was polished off with 600 grit carborundum paper, and the panel was rinsed in dilute sodium hydroxide, rinsed in distilled water and dried.

Figure 2:
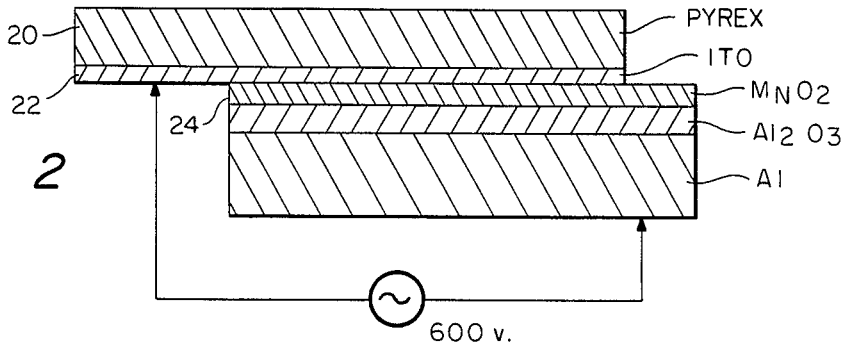
FIG. 2 is a section in elevation of a second embodiment of the lamp in accordance with the present invention using manganese dioxide as a current barrier of low conductivity.

This panel was made into a "sandwich" as shown in FIG. 2 by clamping a piece of glass 20 with a conducting indium-tin oxide film 22 on its surface to the manganese dioxide surface 24 as shown in FIG. 2. Upon the application of a 60 hertz, a.c. potential at 600 volts, a continuous yellow glow was observed over much of the panel surface with an unknown current. The glow had particular brightness in the region where the panel and the conductive glass were most tightly pressed together.

The mechanism is not fully understood but is believed to be the result of space charges within (a) the aluminum oxide $Al_2O_3$ and manganese dioxide $MnO_2$ (N-type semi-conductor) and (b) the oxygen deficient manganese oxide $Mn_2O_3$ formed in the pyrolizing process.

Example No. 8: A metal/metal oxide/insulator/ITO glass lamp was prepared from a panel of No. 3003 aluminum alloy prepared as in Example No. 3 above. The surface of the oxide was completely covered with an insulator consisting of three layers, silicon oxide ($SiO_2$) about 1350 Å in thickness in contact with the oxide, the silicon nitrate ($Si_3N_4$) about 1400 Å in thickness and a top layer of pure aluminum oxide ($Al_2O_3$) about 300 Å in thickness, all applied by conventional sputtering techniques.

After the insulator was applied, the edges of the panel were masked and a 1600 Å thick layer of indium-tin oxide ("ITO") was sputtered thereon.

Figure 3:
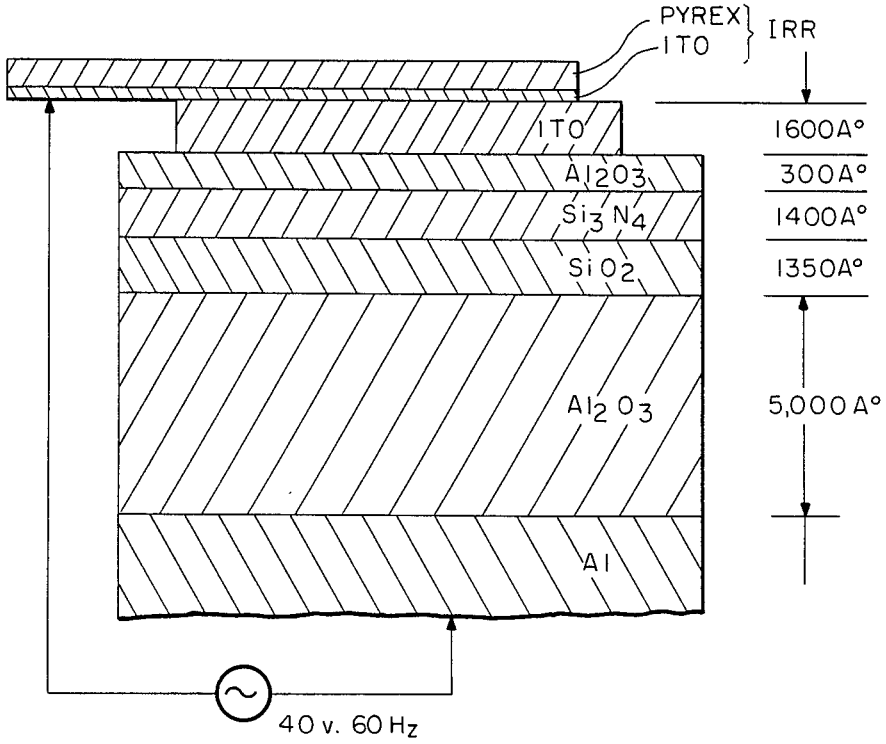
FIG. 3 is a section in elevation of a third embodiment of the lamp of the present invention using an aluminum-/aluminum oxide/insulator/ITO sandwich.

A sheet of IRR glass was then clamped to the ITO side of the panel as shown in FIG. 3, Upon the application of about 40 volts a.c. at 60 hertz and a current of a few microamperes, the panel glowed uniformly with a yellow electroluminescence, not only under the IRR glass but under the ITO coating extending beyond the area contacted by the IRR glass. The glow was low in intensity but increased with voltage without either scintillations or dielectric breakdown.

Figure 4:
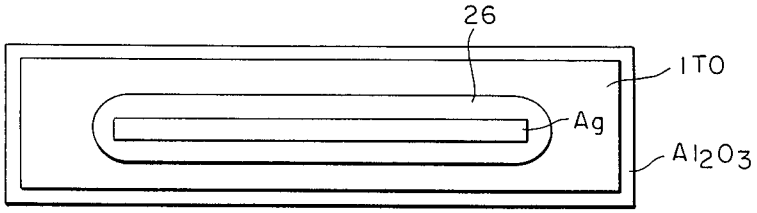
FIG. 4 is a top plan view of a fourth embodiment of the lamp of the present invention with a silver conductor in lieu of the IRR glass of the embodiment of FIG. 3.

Example No. 9: A second panel was prepared as set out in Example No. 8 above. In lieu of the IRR glass, a silver strip was painted down the middle of the ITO film as shown in FIG. 4 to minimize the voltage drop in the ITO film. Contact was made with the silver strip in testing for electroluminescence. When 28 volts a.c. were applied at 60 hertz, electroluminescence was visible in the area 26 contiguous to the silver strip.

There is uncertainty as to the uniformity of the electric field between the aluminum metal and the ITO film. If, as anticipated, most of the field gradient is within the insulator, the field would be about $1\times10^6$ volts per cm, and the electrons would enter the oxide with sufficient energy to excite luminescence in the 3d levels of manganese in the aluminum alloy. However, if most of the field gradient is in the anodization layer, the field there would be about the same order of magnitude with the electrons acquiring within oxide layer sufficient energy to excite the metal ions by collision.

The foregoing examples are to be considered illustrative only and many modifications thereof may occur to those skilled in this art without departing from the spirit of the invention as defined by the following claims when accorded a full range of equivalents.

What is claimed is:

1. A method of producing electroluminescence in a metal oxide which comprises:

(a) providing a porous metal oxide electrolytically grown in an oxalic acid bath, wherein the metal of said metal oxide is selected from the group consisting of Al, Mn, Ta, Ti, Tl, W, Zr, Zn and mixtures thereof, and (b) introducing electrons into the metal oxide in the absence of a chemical reaction by providing an insulator which includes silicon adjacent the oxide and subjecting the insulator to an electric field, the insulator having a thickness about the length of the mean free path of an electron in the electric field to which it is subjected, and said oxide having a thickness about the length of the mean free path of an electron in the electric field to which said insulator is subjected, to thereby excite electrons of the metal ions thereof sufficiently to cause the emission of photons upon the relaxation of such electrons to a valence band energy level.

2. An electroluminescing lamp comprises:

(a) a metal layer wherein the metal is selected from a group consisting of Al, Mn, Ta, Ti, Tl, W, Zr, Zn and mixtures thereof; and (b) a porous metal oxide layer carried by said metal layer, said porous metal oxide layer being electrolytically grown in an acid bath;

(c) an insulator layer including silicon carried by said metal oxide layer, said metal oxide layer being approximately 5,000 Å in thickness and said insulator layer being approximately 3,000 Å in thickness;

(d) a layer of indium tin oxide carried by said insulator;

(e) a layer of IRR glass carried by said indium tin oxide layer; and (f) means for applying an electric potential to said metal layer and said IRR glass.

3. The method of claim 1 wherein the metal oxide is provided by oxidation of a metal to which the oxide is adherent.

4. The method of claim 1 wherein the metal of said metal oxide is aluminum.

5. The method of claim 1 wherein the metal of said metal oxide is tantalum.

6. The method of claim 1 wherein the metal of said metal oxide contains plural metals.

7. The method of claim 1 wherein the metal of said metal oxide is an alloy.

8. The method of claim 7 wherein the alloy includes manganese.

9. The method of claim 1 wherein the introduced electrons are excited to conduction band energy levels prior to introduction into the oxide.

10. The method of claim 1 wherein the introduced electrons are excited adjacent the surface of the oxide.

11. The method of claim 10 wherein the introduced electrons are accelerated by space charges.

12. The method of claim 1 wherein the electrons of the metal ions of the oxide are excited by collision of the introduced electrons with the ions.

13. The method of claim 12 wherein the electrons of the metal ions are not displaced from the metal ion by the collision.

14. The method of claim 12 wherein the electrons of the metal ions are displaced from the metal ion by the collision to thereby create a hole.

15. The method of claim 11 wherein the oxide includes an electronic hole and an introduced electron is trapped thereby to emit a photon.

16. The method of claim 11 wherein the oxide includes a distortion in the oxide lattice and an introduced electron is trapped thereby to emit a photon.

17. The method of claim 15 wherein the distortion is a surface effect of the oxide.

18. The method of claim 15 wherein the distortion is the result of an impurity in the oxide.

19. The lamp of claim 2 wherein said means includes a d.c. source of electric potential.

20. The lamp of claim 2 wherein said means includes an a.c. source of electric potential.

21. The lamp of claim 2 wherein said insulator includes $SiO_2$, $Si_3N_4$ and $Al_2O_3$.

22. The lamp of claim 2 wherein said metal is an alloy.

23. The lamp of claim 22 wherein said alloy includes manganese.

24. The lamp of claim 2 wherein the metal of said metal oxide is aluminum.

25. The lamp of claim 2 wherein the metal of said metal oxide is tantalum.

26. The lamp of claim 2 wherein the metal of said metal oxide contains plural metals.

* * * * *